United States Patent [19]

Hans et al.

[11] Patent Number: 5,054,397

[45] Date of Patent: Oct. 8, 1991

[54] PARACHUTE EJECTION AND RECOVERY SYSTEM FOR ROCKETS

[75] Inventors: Paul C. Hans, Scottsdale, Ariz.; Gary C. Rosenfield, Las Vegas, Nev.

[73] Assignee: Aerotech, Inc., Las Vegas, Nev.

[21] Appl. No.: 517,162

[22] Filed: May 1, 1990

[51] Int. Cl.[5] ..... F42B 4/08; F42B 4/12

[52] U.S. Cl. ..... 102/348; 102/353; 102/354; 102/337; 102/340; 446/52

[58] Field of Search ..... 102/347, 348, 351, 353, 102/354, 355, 498, 502, 337, 340; 446/34, 49, 50, 51, 52, 53, 54, 56, 473, 230, 231

[56] References Cited

U.S. PATENT DOCUMENTS

| | | | |
|---|---|---|---|
| 2,442,528 | 6/1948 | Beattie | 102/35.6 |
| 2,841,084 | 7/1958 | Carlisle | 102/34.1 |
| 3,292,302 | 12/1966 | Estes et al. | 46/74 |
| 3,646,887 | 3/1972 | Stine | 102/34.5 |
| 3,719,145 | 3/1973 | Brown et al. | 102/34.4 |

*Primary Examiner*—Brooks H. Hunt
*Assistant Examiner*—Chrisman D. Carroll
*Attorney, Agent, or Firm*—Richard R. Mybeck

[57] ABSTRACT

Parachute ejection and recovery system for rockets which protects and permits recovery of the entire rocket after launch including means for cooling ejection gases, means for directing the cooler ejection gases for using in ejection, the nose cone and parachute therefrom during flight, and means for controlling descent of the rocket body, its nose cone and a parachute associated therewith.

10 Claims, 1 Drawing Sheet

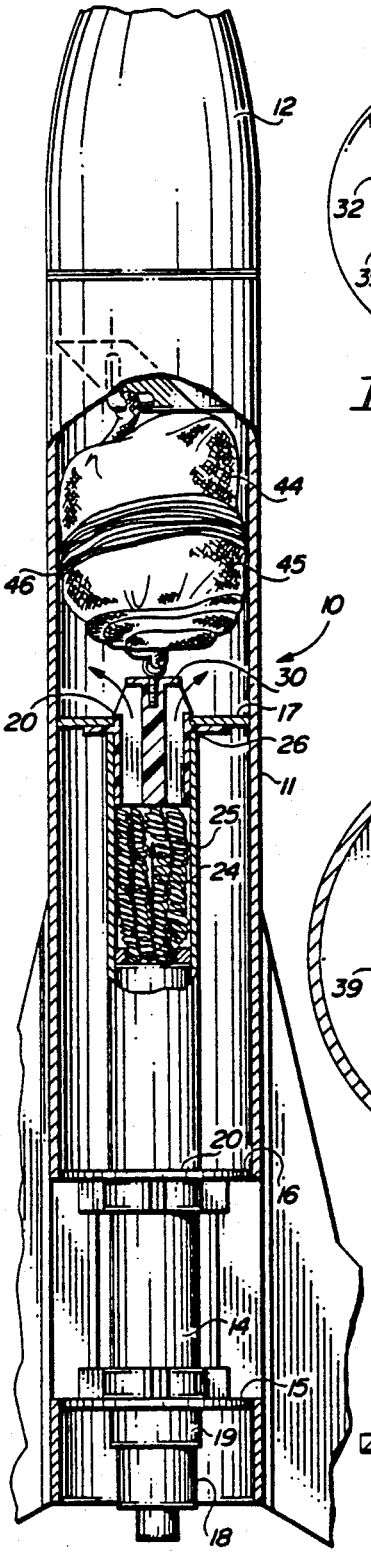
FIG. 1
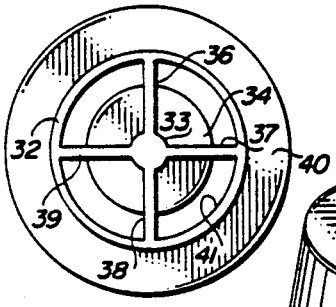
FIG. 6
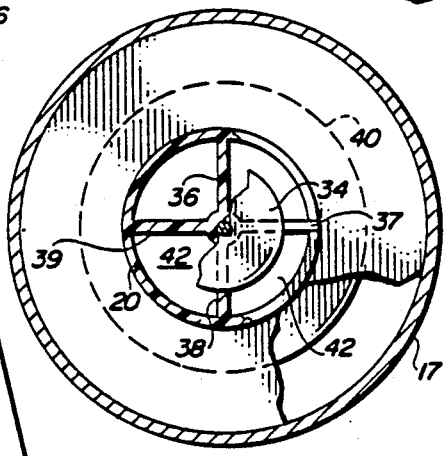
FIG. 3
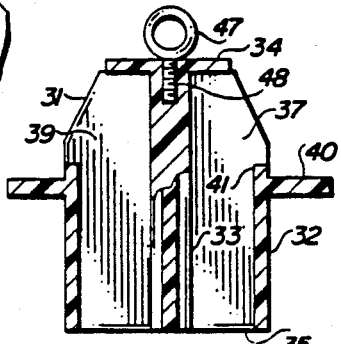
FIG. 5
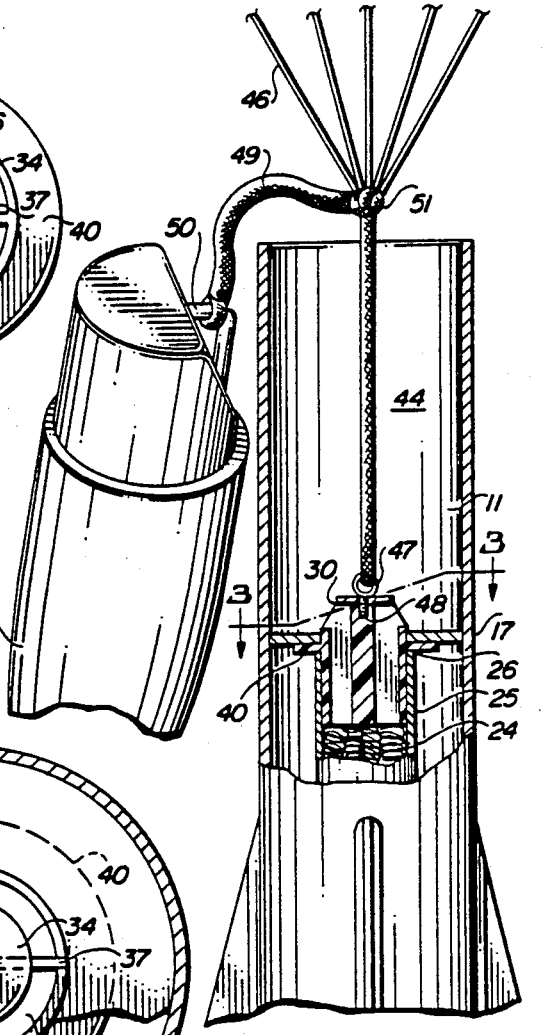
FIG. 2
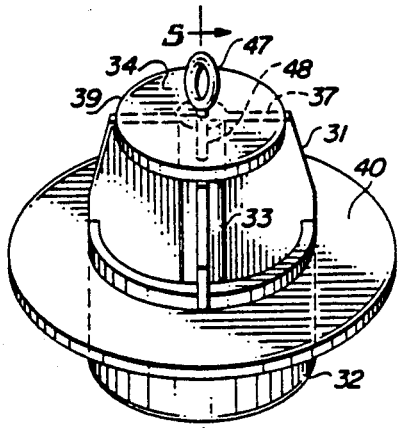
5 FIG. 4

PARACHUTE EJECTION AND RECOVERY SYSTEM FOR ROCKETS

INTRODUCTION

The present invention relates to rockets and more particularly to a new and improved parachute ejection and recovery system which is especially adapted for use with recreational rockets.

BACKGROUND OF THE INVENTION

In the past, numerous rocket ejection and recovery systems have been proposed. Some of these prior systems, while advancing the art to some degree, still possessed serious disadvantages, including the ejection of wadding, asbestos particles and like deliterious substances into the environment. Among these prior art proposals are Beattie who in U.S. Pat. No. 2,442,528 proposed a rocket equipped with a parachute assembly fastened by connecting the shroud lines to a central anchor protected from the hot combustion gases by a "felt" washer, all of which was ejected from the rocket into the atmosphere during flight. Another, Estes et al, in U.S. Pat. No. 3,292,302 taught the use of special wadding to prevent the gases created by the pyrotechnic motor from burning the ejection system. Brown et al, in U.S. Pat. No. 3,719,145 disclosed the use of perforated baffles separated by a cylindrical tube and positioned beneath the recovery system to prevent the burning of the recovery system by hot gases and incandescent particles.

Generally speaking, model rocket recovery systems in use today employ a parachute fastened to the rocket housing and is deployed through the use of a pyrotechnic charge which ejects not only the parachute but the protective wadding into the environment and inevitably leads to the recovery of less than the entire rocket assembly.

BRIEF SUMMARY OF THE INVENTION

The present invention relates to a new and improved rocket ejection and recovery system and more particularly to a novel system which protects and permits recovery of the entire model rocket from loss or destruction and includes means for cooling the ejection gases and directing those gases for controlled engagement with the recovery system. Specifically, the present invention utilizes a novel arrangement of metal mesh member and a unique plastic ventilated seal, all of which is retained within the rocket structure which in turn is linked to the parachute deployed therewith and secured thereto. The metal mesh serves to cool the hot pyrotechnic gases evolved during blast off and recovery parachute deployment while the ventilated seal directs the escape of these pyrotechnic gases to provide sufficient force to launch the parachute recovery assembly. The parachute is securely fastened to the ventilated seal and the nose cone, thereby allowing complete post-launch recovery of all of the rocket components.

Accordingly, a principal object of the present invention is to provide a new and improved parachute ejection and recovery system for rockets which can be quickly and easily assembled by persons having only minimal skills in rocket construction to provide a safe, dependable and complete rocket recovery system which further protects the recovery system from the deleterious effects of hot gases and incandescent particles and minimizes the introduction of such foreign particulates into the atmosphere while enabling recovery of all rocket components after flight.

Another object of the present invention is to provide a new and improved parachute ejection and recovery system for rockets in which the temperature of the combustion gases created by the pyrotechnic charged required for parachute ejection are subtantially reduced to a level below that which would harm the parachute system operatively associated therewith while the force generated thereby ejects the tethered parachute therefrom.

These and still further objects as shall hereinafter appear are readily fulfilled by the present invention in a remarkably unexpected manner as will be readily discerned from the following detailed description of an exemplary embodiment thereof especially when read in conjunction with the accompanying drawing in which like parts bear like numerals throughout the several views.

BRIEF DESCRIPTION OF THE DRAWINGS

FIG. 1 is a partially cut-away cross-sectional prelaunch view of a rocket in combination with a parachute ejection and recovery system embodying the present invention;

FIG. 2 is a fragmented view, partially in cross-section of the rocket of FIG. 1 showing parachute deployment after ejection.

FIG. 3 is a cross-section of the rocket taken on line 3—3 of FIG. 2.

FIG. 4 is an isometric view of a ventilated seal embodying the present invention;

FIG. 5 is a cross-section of the ventilated seal taken on line 5—5 of FIG. 4; and FIG. 6 is a bottom view of the ventilated seal of FIG. 4.

DESCRIPTION OF PREFERRED EMBODIMENT

The present invention relates to rockets and more particularly to a new and improved parachute ejection and rocket recovery system for recreational rockets.

Referring to the drawing and particularly to FIG. 1, a typical rocket is identified by the general reference numeral 10 and basically comprises a body portion 11 and a detachable nose cone 12.

Body portion 11 comprises an elongated tube which contains all of the essential components of rocket 10 including a motor tube 14 which is disposed concentrically within body portion 11 and held in a fixed position relative thereto by lower centering ring 15, middle centering ring 16 and upper centering ring 17. Rings 15, 16, 17 respectively, are disposed within body portion 11 in generally parallel spaced relationship to each other and have an outside diameter substantially equal to the inside diameter of tubular body portion 11.

As is apparent from FIGS. 1 and 2, motor tube 14 is provided with a motor 18 telescopically inserted into the lowermost end 19 of motor tube 14. When assembled, the pyrotechnic propulsion media (not shown) normally disposed in motor 18 is fired and imparts forward motion to the entire rocket assembly 10 thereby launches the rocket.

Motor tube 14 is installed into and seated within tubular body portion 11 by inserting motor tube 14 through the plurality of complementary holes 20 defined in registry with each other in centering rings 15 and 16. As shown in FIG. 1, centering rings 15 and 16 and centering ring 17 when subsequently installed pursuant hereto, coact to maintain motor tube 14 in substantially fixed concentric relationship to and within tubular body portion 11.

A metallic mesh member 24 is disposed into the upper portion 25 of motor tube 14 beneath upper centering ring 17 for a purpose will be hereinafter described in detail.

Into the open mouth 26 of motor tube 14, a unique plastic ventilated seal member 30 is inserted which then receives third centering ring 17 thereabout and coacts therewith to fully stabilize motor tube 14 within tubular body portion 11.

As shown in FIGS. 4, 5 and 6, ventilated seal member 30 comprises an frustoconically contoured upper portion 31, a cylindrical lower portion 32, and a tubular core 33 which extends vertically therethrough between an upper circular member 34 and the bottom edge 35 of lower portion 32.

A plurality of radially extending fin members 36, 37, 38, 39 respectively extend outwardly from core 33 as shown in FIG. 3. Each fin member 36, 37, 38, 39 is disposed in spaced 90° relationship to each adjacent fin member and extends into secure abuttment with centrally-positioned circumscribing annulus 40. Fin members 36, 37, 38, 39 further each extend downwardly from the lower edge of annulus 40 within cylindrical lower portion 32 for integral engagement with the inner wall 41 thereof. The inside diameter of annulus 40 coincides with the outside diameter of cylindrical lower portion 32.

To assemble rocket 10 for launch, member 30 is mounted with cylindrical lower portion 32 telescopically inserted into mouth 26 of motor tube 14 whereupon the central opening 20 in centering ring 17 is passed over upper portion 31 of member 30 into surface-to-surface engagement with annulus 40. When thus installed centering ring 17 coacts with member 30 and rings 15, 16 to fully stabilize motor tube 14 within body member 30 provides a plurality of ventilation openings 42 when installed comprising the gaps defined by and intermediate adjacent fin member 36, 37, 38 and 39. Openings 42 provide a baffled egress for the exhaust gases passing from motor 18 up motor tube 14 into the plenum chamber 44 located in body portion 11 above ring 17 and below nose cone 12.

As shown in FIG. 1, plenum chamber 44 contains a folded parachute 45 which has a plurality of shroud lines 46 associated therewith. A suitable anchor 47 mounted on pin 48 is disposed into the upper circular member 34 on the top of member 30. Pin 48 is mounted along the central axis of core 33. Shroud lines 46 are grouped and a suitable shock cord 49 is passed therethrough and knotted thereabout at junction 51. One end of shock cord 49 is secured to anchor 47 in member 30 and the other end is secured to loop 50 defined in nose cone 12. Shock cord 49 is preferably formed of elastic and resilently connects body portion 11 to both nose cone 12 and parachute 45 which is disposed therebetween. As assembled, parachute 45 is capable of supporting both body portion 11 and nose cone 12 when parachute 45 is fully deployed and descends to earth.

The assembly of rocket 10 is completed by inserting fitted nose cone 12 into body portion 11 for a snug slip fit therewith, without extraneous fastening or adhesive and after parachute 45 and shock cord 49 have been suitably packed into plenum chamber 44. Suitable rocket motor 18, carrying the propulsion media, is then inserted into lower end 19 of motor tube 14, the rocket 10 is placed upon a suitable launcher and ignited in the conventional manner to launch the rocket into the sky.

Once rocket 10 is airborne, the parachute ejection and recovery system is activated at the flight apogee by the expulsion of burn gases, or if desired, by gases from a separate time-delayed parachutes ejects pyrotechnique charge, which gases pass through metallic mesh 24 where heat is dissipated therefrom and subsequently through the ventilator openings 42 in member 30 which increases the internal pressure within plenum chamber 44 and causes nose cone 12 to be ejected out of body portion 11 to expose plenum chamber 44 and cause parachute 45 to be ejected and drawn therefrom by the force thereof.

The ejected nose cone 12, remains attached to shock cord 49 and hence to body portion 11 and parachute 45 while parachute 45 unfurls and advances into its extended mode as illustrated in FIG. 2. As air enters parachute 45 during its initial descent, all of the components of rocket 10 are supported by parachute 45 and can be visually tracked and thereafter recovered for reuse while providing a dramatic recreational display. Rocket 10, when constructed and operated as described herein, provides a joyful recreational experience while substantially reducing the production of pollutants or other environmental contaminants as a result thereof.

From the foregoing, it becomes apparent that a new and useful parachute ejection and recovery system for rockets has herein described and illustrated which fulfill all of the aforestated objectives in a remarkably unexpected fashion. It is of course understood that such modifications, alterations and adaptations as may readily occur to an artisan having the ordinary skills to which this invention pertains are intended within the spirit of the present invention which is limited only by the scope of the claims appended hereto.

Accordingly, what is claimed is:

1. A parachute ejection and recovery system for a recreational rocket comprising in combination: a nose cone; a body portion, said nose cone being telescopically inserted within said body portion for launch and ejectable therefrom during rocket flight; a parachute having shroud lines attached thereto and disposed thereabout, said parachute being disposed within said body portion and ejectable from within said body portion during flight; shock cord means anchored on the longitudinal axis of said body portion, and connected to said nose cone through said shroud lines to attach said nose cone and said body portion to said parachute for descent therewith after said nose cone is ejected from said body portion during rocket flight.

2. A parachute ejection and recovery system according to claim 1 in which said body portion comprises a tubular housing member, a plurality of centering rings mounted with in said housing member in spaced generally parallel relationship to each other, each of said rings having an opening centrally defined therethrough in registry with like opening in said other rings, a motor tube disposed within said ring openings in said centering ring in concentric relationship to said housing member, said motor tube having an upper portion and a lower portion; a pyrotechnic charge mounted in said lower portion of said motor tube and actuatable to explode; a metallic mesh member disposed in said upper portion of said motor tube and operative to dispel heat from exhaust gases created by the explosion of said pyrotechnic charge; a ventilated seal means disposed in said motor tube in superposition to said mesh member for directing said exhaust gases from said metallic mesh member to eject said nose cone and said parachute from within body portion during rocket flight.

3. A parachute ejection and recovery system according to claim 2 in which said ventilated seal means comprises a member having a frustoconically contoured upper portion, a cylindrical lower portion, and a tubular core extending vertically therethrough.

4. A parachute ejection and recovery system according to claim 3 in which said ventilated seal means further comprises an upper circular member, a plurality of fin members extending radially from said core between said upper circular member and said lower portion and defining ventilation openings therebetween.

5. A parachute ejection and recovery system according to claim 4 in which said fin members are disposed at a 90° angle with each adjacent one of said fin members.

6. A parachute ejection and recovery system according to claim 4 having an anchor ring disposed on the central axis of said upper circular member and secured thereto, said anchor ring being adapted to receive and secure one end of said shock cord thereto.

7. A parachute ejection and recovery system according to claim 6 in which said fin members are disposed at a 90° angle with each adjacent one of said fin member.

8. A parachute ejection and recovery system according to claim 6 in which said nose cone has a retaining loop defined therein adapted to receive and secure another end of said shock cord thereto.

9. A parachute ejection and recovery system according to claim 8 in which said shroud lines are secured by said shock cord intermediate said anchor ring and said retaining loop.

10. A parachute ejection and recovery system for a recreational rocket comprising in combination: a nose cone; a body portion, said nose cone being telescopically attachable to said body portion for launch and separable therefrom during flight; a parachute disposed in said body portion and ejectable therefrom during flight; resillent chock cord means centrally anchored within said body portion and secured to said nose cone through said parachute to attach said nose cone and said body portion to said parachute for descent therewith after said nose cone is ejected from said body portion during rocket flight; a pyrotechnic charge mounted in said body portion in axial spaced relationship to said parachute; and a metallic mesh member disposed in said body portion intermediate said pyrotechnic charge and said parachute and operative to dispel heat from exhaust gases created by the explosion of said pyrotechnic charge and protect said parachute from the adverse effects thereof.

* * * * *